US005153359A

United States Patent [19]

Lishness

[11] Patent Number: 5,153,359

[45] Date of Patent: Oct. 6, 1992

[54] CATRIDGE MAGAZINE FOR USE WITH DIFFERENT TYPE CARTRIDGES AND METHOD OF DISPENSING CARTRIDGES

[76] Inventor: Bryant L. Lishness, 84 Lynn Rd., Bristol, Conn. 06010

[21] Appl. No.: 445,813

[22] Filed: Dec. 5, 1989

[51] Int. Cl.[5] ..... F41A 9/70

[52] U.S. Cl. ..... 42/50

[58] Field of Search ..... 42/18, 22, 50, 7

[56] References Cited

U.S. PATENT DOCUMENTS

| | | | |
|---|---|---|---|
| 1,407,633 | 2/1922 | Burton | 42/50 |
| 2,296,729 | 9/1942 | Mossberg | 42/50 |
| 2,396,816 | 3/1946 | Boudreau | 42/50 |
| 2,840,944 | 7/1958 | Thompson | 42/50 |
| 2,870,561 | 1/1959 | Colby | 42/18 |
| 3,619,929 | 11/1971 | Fremont | 42/50 |
| 4,314,419 | 2/1982 | Koon | 42/50 |
| 4,514,922 | 5/1985 | Farrar et al. | 42/50 |
| 4,566,212 | 1/1986 | Chesnut | 42/50 |
| 4,586,281 | 5/1986 | Chesnut | 42/50 |
| 4,777,752 | 10/1988 | Howard | 42/50 |
| 4,805,333 | 2/1989 | Doria et al. | 42/50 |
| 4,888,899 | 12/1989 | Chestnut et al. | 42/50 |

*Primary Examiner*—Stephen C. Bentley
*Attorney, Agent, or Firm*—Perman & Green

[57] ABSTRACT

A magazine for dispensing different types of cartridges. The magazine can dispense regular round nose cartridges and also has a ramp stamped into a front face of the magazine housing that can contact leading portions of cartridges having hollow tip noses or flat tip noses for guiding the leading portions out of the magazine and thereby prevent jamming.

7 Claims, 3 Drawing Sheets

CATRIDGE MAGAZINE FOR USE WITH DIFFERENT TYPE CARTRIDGES AND METHOD OF DISPENSING CARTRIDGES

BACKGROUND OF THE INVENTION

1. Field of the Invention

This invention relates to a firearm cartridge magazine for use with an automatic feeding firearm and, more particularly, to a magazine capable of dispensing different types of cartridges without substantial risk of a cartridge becoming jammed in the magazine.

2. Prior Art

U.S. Pat. No. 4,566,212 to Chesnut discloses a cartridge clip with camming surfaces adjacent the top edge of the clip so that the cartridge will move properly out of the clip and into a firearm. U.S..Pat. No. 2,870,561 to Colby discloses a cartridge positioner engageable with the underside of the front end of a cartridge. Other U.S. Patents relating to magazines include U.S. Pat. No. 4,777,752, U.S. Pat. No. 4,586,281, U.S. Pat. No. 2,396,816, and U.S. Pat. No. 4,805,333. Various different types of cartridges also exist in the prior art. One way in which cartridges having the same caliber can differ is with different types of bullet noses or tips. Various types of bullet noses include a round or ball nose, a flat nose, a hollow point nose, a hollow point nose with teeth, and a hollow point nose with a flat tip.

Various problems have arisen with the automatic feeding of cartridges having the same caliber but different types of noses from cartridge magazines. Cartridge magazines in the past were generally designed for use in a certain type or types of firearm and with the most common form of cartridge having a round or ball point nose. However, it is desirable that a firearm be usable with a cartridge magazine that can house and dispense a certain caliber of cartridge regardless of the type of size or shape of cartridge nose. Thus, an operator need not have different types of magazines for each type of cartridge having a different nose. Rather, a single type of magazine is desired for use with different type nose cartridges. However, no cartridge magazine in the prior art has been provided that can adequately function with different types of cartridges having different noses without jamming of cartridges while feeding.

It is therefore an objective of the present invention to provide a cartridge magazine that can be used with various different types of cartridges having different noses. Other objectives, advantages and features of the present invention will become evident below.

SUMMARY OF THE INVENTION

The foregoing problems are overcome and other advantages are provided by a cartridge magazine capable of dispensing at least two types of cartridges.

In accordance with one embodiment of the present invention, a firearm cartridge magazine is provided which is capable of individually dispensing a plurality of cartridges housed therein. The magazine comprises a magazine housing, a means for biasing housed cartridges, and a means for dispensing at least two types of cartridges. The magazine housing forms a cartridge housing chamber with a relatively open top and a front wall. The means for biasing housed cartridges can bias cartridges towards the relatively open top. The means for dispensing at least two types of cartridges can dispense a first type of cartridge having a first length and a relatively round nose and a second type of cartridge having a second relatively shorter length and a relatively flat nose. The means for dispensing at least two types of cartridges has a means for guiding a leading portion of a cartridge in an upward direction as the cartridge is being dispensed from the magazine. The means for guiding comprises a relatively stationary ramp portion at an interior side of the front wall.

In accordance with another embodiment of the present invention, a firearm cartridge magazine is provided comprising a bottom, a back wall, two side walls, and a front wall with at least one of the walls comprising a cartridge ramp. The cartridge ramp is located proximate a forward top portion of the front wall in a housing area. The ramp has a top ramp surface for contacting an underside of a leading portion of a cartridge being dispensed from the magazine. The housing area is capable of housing a first type of cartridge with a first length and a second type of cartridge with a second length. The ramp is suitably sized and shaped to allow passage of both types of cartridges therepast and wherein the first type of cartridge can be dispensed from the magazine without contacting the ramp and the second type of cartridge cannot be dispensed from the magazine without contacting the ramp such that the ramp can, at least partially, guide the leading portion of a second type of cartridge out of the magazine, prevent damage to the leading portion of the second type of cartridge, and prevent the second type of cartridge leading portion from being stationarily wedged against the front wall of the magazine.

In accordance with another embodiment of the present invention, a firearm cartridge magazine is provided for individually dispensing a supply of housed cartridges. The magazine has a housing with a bottom wall, a rear wall, a front wall, two side walls, a relatively open top and forming a chamber for housing a plurality of cartridges. The magazine further comprises a spring located in the chamber with a follower for biasing housed cartridges towards the relatively open top, wherein the improvement comprises the front wall being inwardly dented to form a ramp portion extending into the chamber at a top portion of the front wall and having a ramp surface for contacting a leading portion of a cartridge as the cartridge is pushed forward by a leading portion of a firearm bolt, the ramp surface being capable of guiding the cartridge, at least partially, out of the magazine as the cartridge is pushed forward.

In accordance with one method of the invention, a method is provided of dispensing cartridges from a firearm cartridge magazine, having a housing, into a barrel of a firearm comprising the steps of contacting a rear end of a cartridge with the leading portion of a bolt at a location offset from a center axis of the cartridge, the cartridge being held in a dispensing position with its leading portion being spaced from a forward portion of the magazine housing; pushing the cartridge with the bolt in forward direction at the rear end offset location; tilting the leading portion of the cartridge in a downward direction due to the offset pushing at the cartridge rear end; and contacting a ramp on a forward portion of the magazine housing with an underside portion of the leading portion of the cartridge, the ramp having a relatively sloped ramp surface such that, as the cartridge is further pushed, the ramp surface guides the leading portion of the cartridge, at least partially, in an upward direction.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
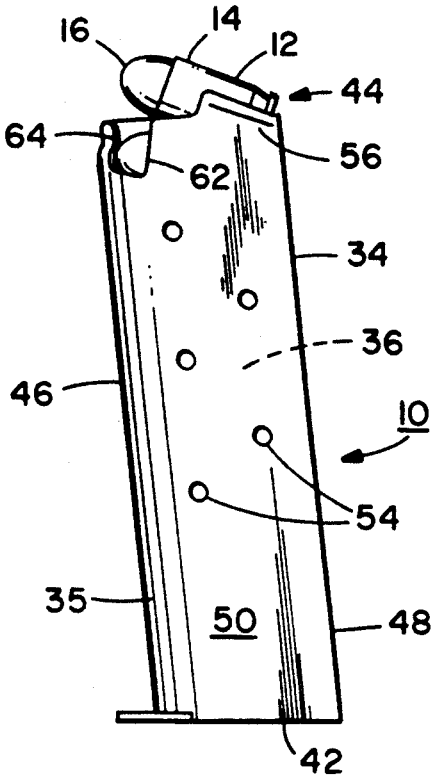
FIG. 1 is a plan side view of a cartridge magazine having cartridges therein incorporating features of the present invention.

Referring to FIG. 1, there is shown a plan side view of a cartridge magazine 10 incorporating features of the present invention. While the following description is with reference to the embodiment shown in the drawings, it should be understood that the present invention is capable of use in various forms, in various types of applications, and in various methods of use. In addition, any suitable size, shape or type of materials can be used as elements in the embodiment of the present invention.

In the embodiment shown in FIG. 1, the cartridge magazine 10 is generally provided for housing and dispensing cartridges 12 into a barrel of a semi-automatic or automatic firearm (not shown). Cartridges 12, as are known in the art, generally comprise an outer casing 14, a projectile or bullet 16 and a supply of gun powder (not shown) inside the casing 14 for propelling the bullet 16.

Figure 2A:
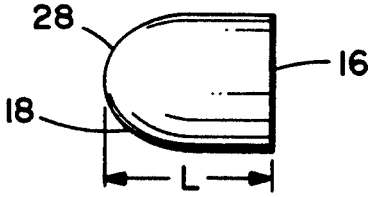
FIG. 2A is a plan side view of a bullet having a ball nose.
Figure 2B:
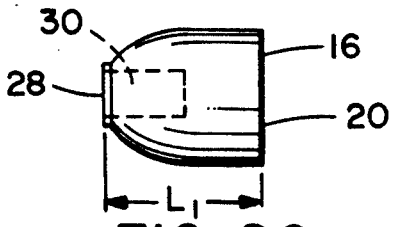
FIG. 2B is a plan side view of a bullet having a hollow point nose.
Figure 2C:
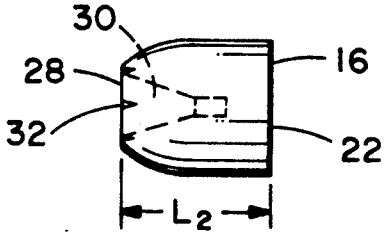
FIG. 2C is a plan side view of a bullet having a hollow point nose with teeth.
Figure 2D:
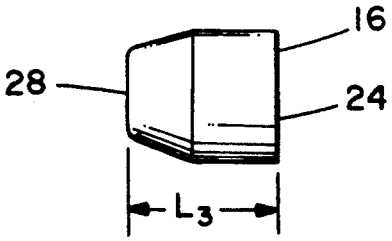
FIG. 2D is a plan side view of a bullet having a flat nose.
Figure 2E:
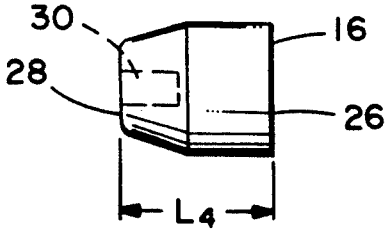
FIG. 2E is a plan side view of a bullet with a hollow point nose having a flat tip.

Referring now to FIGS. 2A through 2E, plan side views of various different types of bullets 16 are shown. FIG. 2A shows a ball nose or round nose bullet 18 having a relatively rounded leading edge 28 and a length L. FIG. 2B shows a hollow point nose bullet 20 having a relatively flat leading edge 28, a center depression 30, and a length $L_1$ which is less than the length L of the ball nose bullet 18 in FIG. 2A. FIG. 2C shows a hollow point bullet with teeth 22 having a relatively flat leading edge 28, a center depression 30, side depressions 32 at the leading edge 28, and a length $L_2$ which is less than the length L of the ball nose bullet 18 in FIG. 2A. FIG. 2D shows a flat nose bullet 24 having a relatively flat leading edge 28 and a length $L_3$ which is smaller than the length L of the ball nose bullet 18 in FIG. 2A. FIG. 2E shows a hollow point bullet with flat nose 26 having a relatively flat leading edge 28, the center depression 30, and a length $L_4$ which is less than the length L of the ball nose bullet 18 shown in FIG. 2A. Generally, any suitable caliber of cartridge may be provided with any of these different types of bullets, thus providing different types of cartridges. As described above, problems arise in automatic feeding of different types of cartridges having different types of bullets. Generally, these problems are caused by the fact that bullet leading edges 28 can have different shapes, such as flat, and cartridge length can also vary due to the shape of the leading edge of the bullets. These two factors can result in the relatively flat leading edges becoming jammed against the front wall in a cartridge magazine during feeding as will further be described below.

Referring now to FIGS. 1, 4A, 4B and 5A, the cartridge magazine 10 is generally comprised of a housing 34 forming a center chamber 36 with a spring 38 and follower 40 therein. The spring 38 and follower 40 can generally bias cartridges in the center chamber 36 in an upward direction as is known in the art. The housing 34 generally comprises a bottom member 42 that forms a bottom to the housing 34 and a sheet metal member 35 that is shaped to form a front wall 46, a rear wall 48, and two side walls 50 and 52. Holes 54 are provided through both side walls 50 and 52 for visually determining the number of cartridges 12 in the center chamber 36. In the embodiment shown, a view channel 62 is also provided at the top 44 of the housing for visually determining the presence of a cartridge below the top cartridge. The top 44 is substantially open for individually inserting and dispensing cartridges. Located at the top of the sidewalls 50 and 52 are cartridge retaining lips 56 and 58 which can hold the top cartridge in the housing at a relatively angled dispensing position as shown in FIG. 1. Located at the top of the rear wall 48 is a rear channel 60 which is generally provided such that a slide or bolt from a firearm can contact a rear face 15 of a cartridge 12.

In the embodiment shown, the front wall 46 is relatively curved and located proximate the top of the front wall 46 is a ramp 64. The ramp 64 generally comprises a top surface 66 and a bottom surface 68. In the embodiment shown, the ramp 64 generally extends into the center chamber 36 and is actually comprised of a portion of the front wall 46 having been stamped or indented as shown. The ramp 64 generally acts as a guide for cartridges having noses such as those shown in FIGS. 2B–2E to prevent their leading edge 28 from becoming jammed against the front wall 46 as will be described below.

Figure 3B:
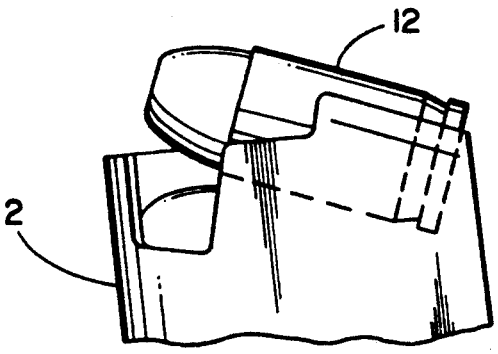
FIG. 3B PRIOR ART
FIG. 3B is a plan side view of a top portion of the cartridge magazine shown in FIG. 3A having a flat nose cartridge therein.
Figure 3A:
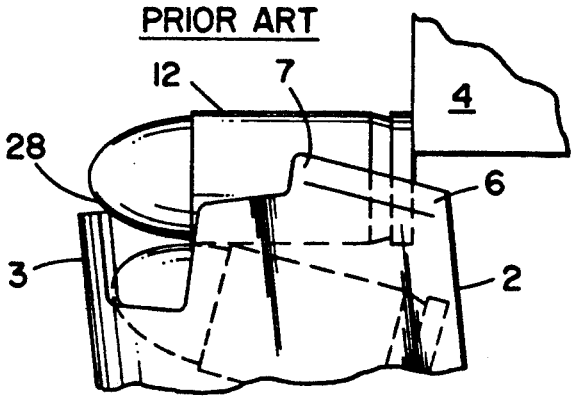
FIG. 3A PRIOR ART
FIG. 3A is a plan side view of the top of a cartridge magazine known in the prior art having a ball nose cartridge pushed by a firearm bolt or slide.
Figure 3C:
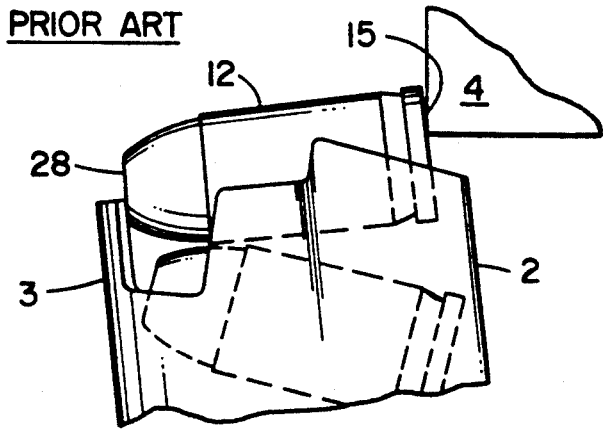
FIG. 3C PRIOR ART
FIG. 3C is a plan side view of the cartridge magazine of FIG. 3B wherein the top most cartridge is being pushed by a firearm slide or bolt and has become jammed against the front wall of the cartridge magazine.
Figure 4A:
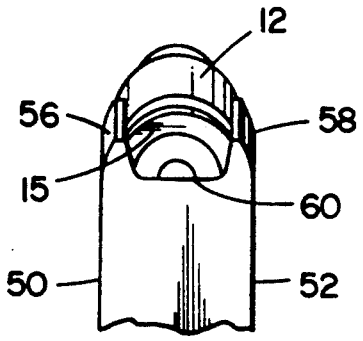
FIG. 4A is a plan rear view of the top of the magazine cartridge shown in FIG. 1.
Figure 4B:
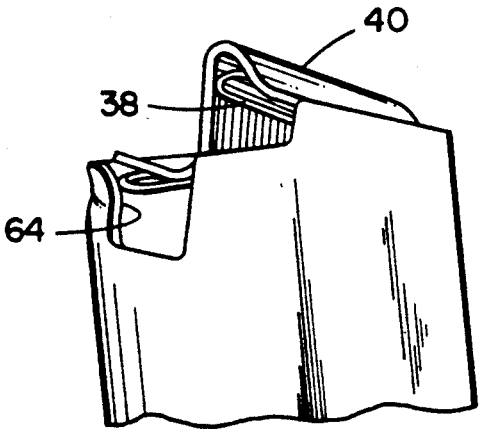
FIG. 4B is a plan side view of the top of the cartridge magazine shown in FIG. 1 not having cartridges housed therein.

Referring now to FIGS. 3A, B, and C the problems encountered with automatic feeding of cartridges in the prior art cartridge magazines will be further described. FIG. 3A shows the top of a cartridge magazine 2 having a ball nose cartridge 12 being pushed forward by a firearm slide or bolt 4 having its leading edge 28 contacting the top of a front wall 3. As can be seen, the front wall 3 in the prior art magazine is curved, but substantially vertically straight. As can be seen in FIG. 3A, when the slide or bolt 4 contacts the rear face 15 of the cartridge 12 the slide 4 pushes the cartridge 12 at a location offset from the center axis of the cartridge. This offset force causes the cartridge 12 to tip or rotate leading edges 7 of the lips 6 from its relatively angled dispensing position to a relatively horizontal position. For the cartridge having a ball nose bullet this rotation or tipping does not substantially interfere with the automatic feeding of the cartridge from the magazine 10 to a chamber of the firearm because the curved shape of the leading edge 28 merely slides along the top of the front wall 3. The problem arises however with cartridges having the type of noses shown in FIGS. 2B–2E. As shown in FIG. 3B, a cartridge having a flat nose is shown at the relatively angled dispensing position biased upwardly against the cartridge lips 56 and 58. Referring also to FIG. 3C, when the slide or bolt 4 of a firearm contacts the rear face 15 of the cartridge 12, the cartridge 12 moves forward and is tipped or rotated at the leading edges of the retaining lips in a similar manner to a cartridge having a ball nose bullet, the cartridge casing being the same. However, the cartridge 12 having a flat nose bullet, with its relatively shorter length and relatively flat leading edge, does not merely slide off the top of the front wall 3 of the magazine 2. Instead, as shown in FIG. 3C, the relatively flat leading edge 28, the relatively short length of the cartridge, and the tilting by the offset force against the rear face 15 of the cartridge moves the relatively flat leading edge 28 against the front wall 3 such that the leading edge 28 of the cartridge 12 becomes jammed between the slide 4 and the front wall 3 thereby disrupting the automatic feed of the cartridge to the firearm. The profile of the top edges of the magazine 2 is generally designed to provide a sufficient channel for guiding a cartridge into a chamber of a firearm without inhibiting movement of the bolt or slide 4. Thus, potential changes to the profile of the top edges of the housing are preferably avoided.

Figure 5A:
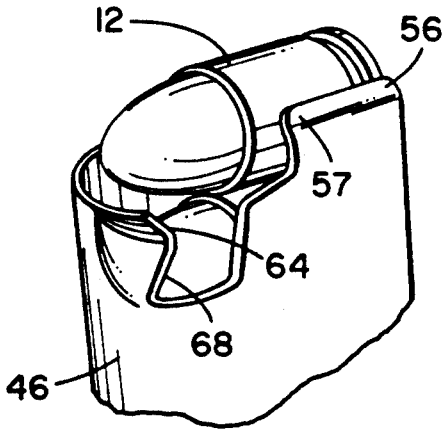
FIG. 5A is a perspective view of the top of the cartridge magazine shown in FIG. 1.
Figure 5B:
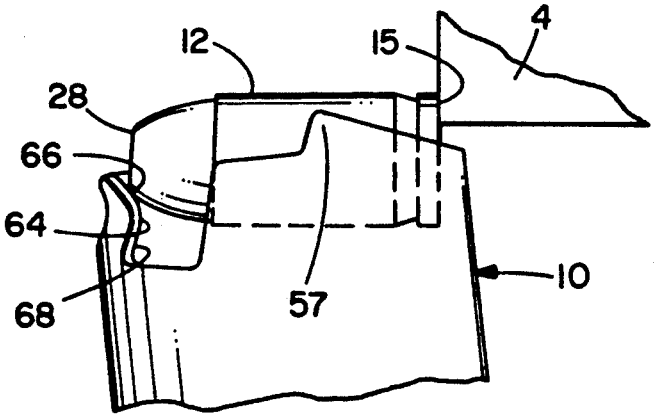
FIG. 5B is a plan side view of the top of the cartridge magazine shown in FIG. 1 having a flat nosed cartridge being pushed by a firearm slide or bolt and contacting the cartridge magazine ramp.
Figure 5C:
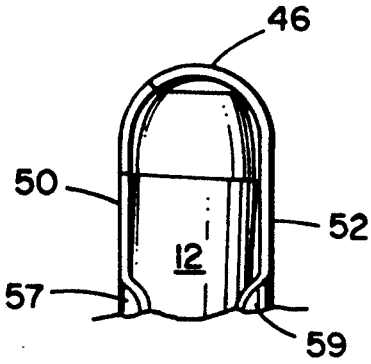
FIG. 5C is a plan top view of the cartridge and cartridge magazine shown in FIG. 5B.
Figure 5D:
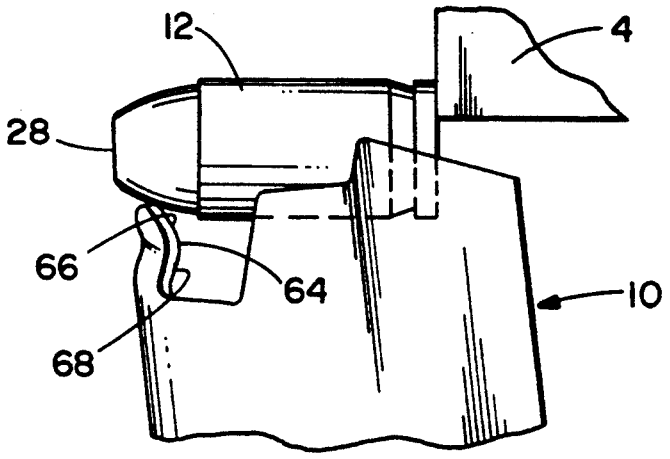
FIG. 5D is a plan side view of the cartridge and cartridge magazine shown in FIG. 5B wherein the cartridge magazine ramp has guided the leading portion of the cartridge out of the cartridge magazine.
Figure 6:
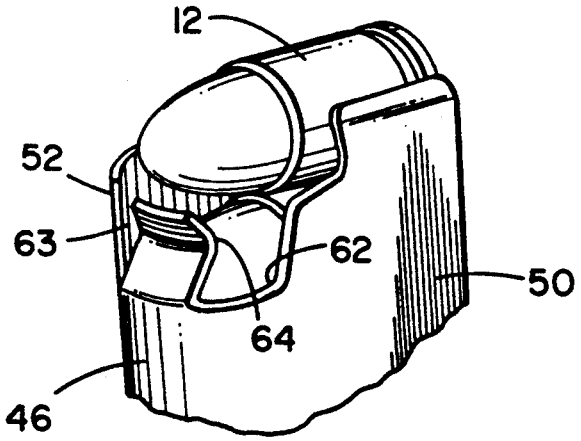
FIG. 6 is a front perspective view of the top of an alternate embodiment of the present invention.

Referring now to FIGS. 5B, 5C, and 5D, dispensing of cartridges from the magazine 10 incorporating features of the present invention will be described. In the embodiment shown, when the slide or bolt 4 contacts and pushes the rear face 15 of the flat nose cartridge, the cartridge is rotated or tilted as in the prior art magazines. However, the underside of the leading edge 28 of the cartridge 12 contacts the top side 66 of the ramp 64. Because the top surface 66 is relatively sloped and the slide 4 is still pushing against the rear face 15 of the cartridge, the cartridge 12 continues to move in a forward direction with the top surface 66 of the ramp 64 guiding the leading edge 28 in an upward direction thereby guiding the leading edge 28 of the cartridge 12 out of the cartridge magazine 10 as shown in FIG. 5D. The force of the slide 4 can continue to push against the rear face 15 with the firearm (not shown) further guiding the cartridge into a firing chamber. In addition to use with cartridges having bullets as shown in FIGS. 2B–2E, the magazine 10 is also capable of use with the relatively longer cartridges having ball nose bullets. Although the ramp 64 extends into the center chamber 36, this does not interfere with the upward feeding of cartridges through the center chamber 36. Generally, as cartridges are dispensed from the top of the magazine 10, other cartridges located in the center chamber 36 proceed upwardly towards the relatively open top 44. Leading edges 28 of the cartridges can contact the front wall 46 as they are fed upwardly. The bottom surface 68 of the ramp 64 substantially prevents the leading edge of a cartridge from being trapped or caught under the ramp 64. In a preferred embodiment of the invention, the ramp 64 extends into the center chamber 36 from about 1/16 to about ⅛ of an inch. The cartridge having a ball nose need not contact the ramp 64, but rather, can merely contact the top surface of the front wall 46. In addition to the camming action of the ramp 64, because the top of the magazine 10 has the view channel 62 provided as a slot extending down from the top edge of the housing 34, the top portion of the front wall 46, in the embodiment shown, may also be capable of spring-like movement when contacted by the leading edge of a cartridge. This movement of the ramp 64 may assist in allowing the top surface 66 of the ramp to the further inclined for more easily guiding a cartridge thereon. In an alternate embodiment, as shown in FIG. 6, the housing 34 may also include a second slot 63 opposite the view channel 62 in the second side wall 52 such that the top portion of the front wall 46 is substantially cantilevered. However, neither the slot view channel 62 or second slot 63 need be provided.

Although camming surfaces at the top of cartridge clips are known in the prior art, as in U.S. Pat. No. 4,566,212 to Chesnut described above, nowhere has there been addressed the particular problem solved by the present invention or the particular method and apparatus for solving this problem. Basically, the present invention solves the problem of automatic feeding of different types of cartridges from a cartridge magazine without jamming of the feeding process. This problem is particularly acute in pistols where the relatively small size of the firearm effectively prevents design changes to accommodate cartridges having relatively flat noses because of substantial costs in redesign and manufacturing procedures. Thus, the present invention allows the use of both regular ball nose cartridges and cartridges having relatively flat noses, such as those shown in FIGS. 2B–2E, in a single type of magazine without the need for modifying the firearm. The present invention, by merely stamping or indenting the top of the front wall 46 of the sheet metal member 35 in the shape and size indicated prevents jamming of cartridges having relatively flat noses, still provides proper feeding of cartridges off of the top edge of the front wall 46 into a chamber of the firearm, and can be manufactured at a significantly small cost when compared to redesigning and manufacturing the firearm. The use of the stamped or indented ramp 64 of the present invention allows the profile of the top edges of the magazine 10 to remain substantially the same as in prior art magazines. Instead, in the embodiment shown, the stamped or indented ramp 64 merely changes the shape of the front wall beneath the top edge of the front wall to enhance cartridge feeding from the magazine without hindering the movement of the bolt or diminishing feeding of the cartridge into a chamber of the firearm.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm cartridge magazine comprising:

a bottom;

a back wall connected to said bottom;

two opposite side walls connected to said bottom and said back wall, each side wall having a cartridge retaining lip at a top end thereof; and a front wall between said two side walls, said walls and bottom defining a cartridge housing area and at least one of said walls comprising a cartridge ramp located proximate a forward top portion of said front wall in said housing area, said walls being comprised of sheet metal with said ramp being formed by a portion of said sheet metal being inwardly indented and having a top ramp surface for contacting an underside of a leading portion of a cartridge being dispensed from the magazine, said housing area being capable of housing a first type of cartridge with a first length and a second type of cartridge with a second length, said ramp being suitably sized and shaped to allow passage of both types of cartridges therepast, and wherein the first type of cartridge can be dispensed from the magazine without contacting said ramp and the second type of cartridge cannot be dispensed from the magazine without contacting said ramp such that said ramp can at least partially, guide the leading portion of a second type of cartridge out of the magazine, prevent damage to the leading portion of the second type of cartridge, and prevent the second type of cartridge leading portion from being stationarily wedged against said front wall.

2. A magazine as in claim 1 further comprising a spring member and follower member for biasing cartridges towards said top end.

3. A magazine as in claim 1 wherein said front wall is curved and has said cartridge ramp stamped therein.

4. A magazine as in claim 1 wherein said top ramp surface is relatively sloped.

5. A magazine as in claim 1 wherein said ramp is comprised of said front wall having been stamped to inwardly project a portion of said front wall into said housing area.

6. A firearm cartridge magazine capable of individually dispensing a plurality of cartridges housed therein, the magazine comprising:

a magazine housing forming a cartridge housing chamber with a relatively open top, two opposite side walls with cartridge retaining lips for contacting a top cartridge, and a front wall;

means for biasing housed cartridges towards said relatively open top, said lips and said means for biasing cooperating to hold the top cartridge at a relatively angled position; and means for dispensing at least two types of cartridges, a first type of cartridge having a first length and a relatively round nose and a second type of cartridge having a second relatively shorter length and a relatively flat nose, said means for dispensing at least two types of cartridges having means for guiding a leading portion of a cartridge in an upward direction as the cartridge is being dispensed from the magazine, said means for guiding comprising a relatively stationary ramp portion at an interior side of said front wall wherein said lips and means for biasing provide a relatively angled position with a leading edge of a cartridge at said position being suitably spaced from said front wall such that upon dispensing of the cartridge a first type of cartridge will not contact said ramp portion, but can contact a top side of said front wall, and a second type of cartridge can contact said ramp portion.

7. A firearm cartridge magazine capable of individually dispensing a plurality of cartridges housed therein, the magazine comprising:

a magazine housing forming a cartridge housing chamber with a relatively open top and a front wall, said housing front wall having a top portion that is at least partially deflectable by contact with a leading portion of a cartridge;

means for biasing housed cartridges towards said relatively open top; and means for dispensing at least two types of cartridges, a first type of cartridge having a first length and a relatively round nose and a second type of cartridge having a second relatively shorter length and a relatively flat nose, said means for dispensing at least two types of cartridges having means for guiding the leading portion of a cartridge in an upward direction as the cartridge is being dispensed from the magazine, said means for guiding comprising a relatively stationary ramp portion at an interior side of said front wall.

* * * * *